United States Patent [19]

Hyde et al.

[11] 4,132,362

[45] Jan. 2, 1979

[54] SPRAY HEAD

[75] Inventors: Paul E. Hyde; Russell N. Miller, both of Corvallis, Oreg.

[73] Assignee: Neptune Microfloc, Inc., Corvallis, Oreg.

[21] Appl. No.: 725,780

[22] Filed: Sep. 23, 1976

[51] Int. Cl.[2] ..... B05B 1/26

[52] U.S. Cl. ..... 239/453; 239/454; 239/506

[58] Field of Search ..... 239/107, 11, 453, 454, 239/506, 514, 515, 524, 570, 571, 516, 382, 383

[56] References Cited

U.S. PATENT DOCUMENTS

| | | | |
|---|---|---|---|
| 225,092 | 3/1880 | Aldersons et al. | 239/524 |
| 962,512 | 6/1910 | Luehrs | 239/107 |
| 1,409,268 | 3/1922 | Wilkie | 239/514 |
| 1,876,669 | 9/1932 | Harlow | 239/524 X |
| 2,754,895 | 7/1956 | Hershey | 239/524 X |

FOREIGN PATENT DOCUMENTS

| | | | |
|---|---|---|---|
| 319452 | 9/1929 | United Kingdom. | |
| 373591 | 1/1932 | United Kingdom | 239/453 |
| 409918 | 5/1934 | United Kingdom. | |
| 535451 | 4/1941 | United Kingdom | 239/514 |
| 620374 | 3/1949 | United Kingdom | 239/453 |
| 652203 | 4/1951 | United Kingdom | 239/382 |
| 675269 | 7/1952 | United Kingdom. | |
| 719679 | 12/1954 | United Kingdom. | |
| 737791 | 10/1955 | United Kingdom | 239/453 |
| 1142887 | 2/1969 | United Kingdom. | |

*Primary Examiner*—John J. Love

*Attorney, Agent, or Firm*—Klarquist, Sparkman, Campbell, Leigh, Hall & Whinston

[57] ABSTRACT

A spray head apparatus having a liquid deflecting back plate which utilizes the Coanda effect to achieve a widely dispersed spray pattern is disclosed. The back plate is vertically movable and is positioned above and biased toward the upwardly facing open end of a vertical flow pipe so that the back plate rises as the pressure of a liquid inside the flow pipe increases.

13 Claims, 4 Drawing Figures

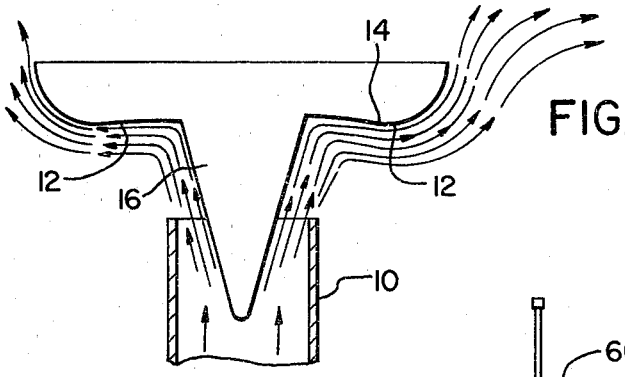
FIG. 1
FIG. 4
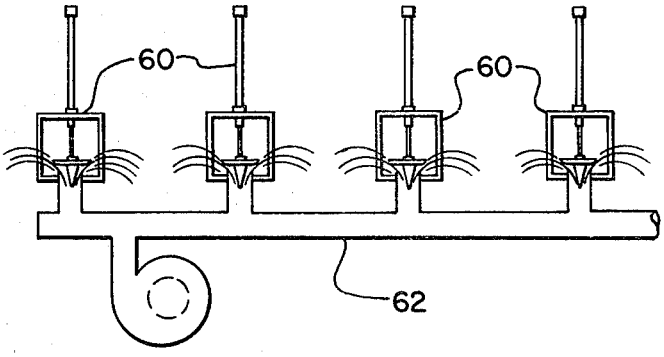
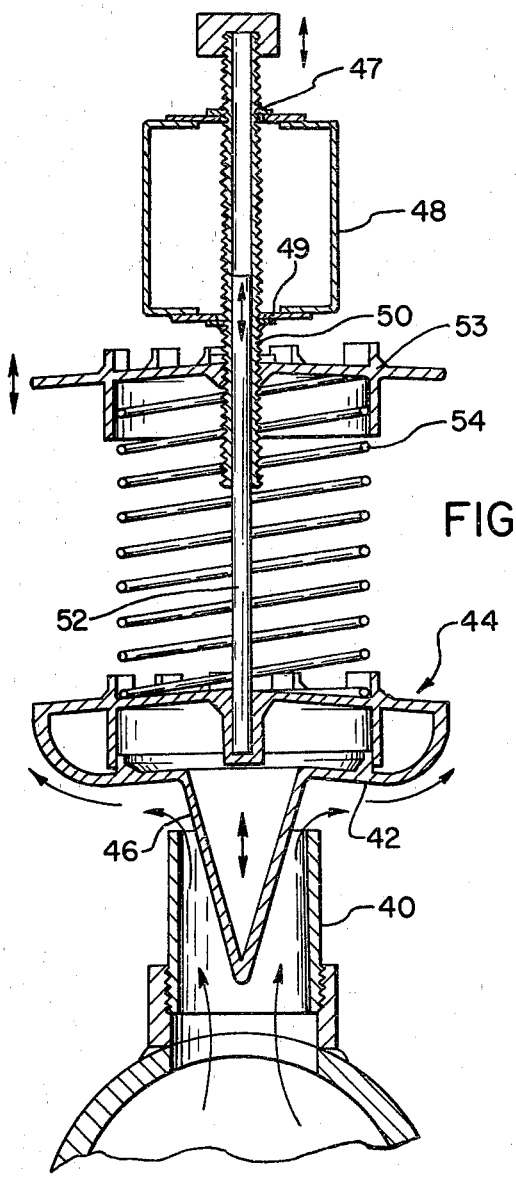
FIG. 3
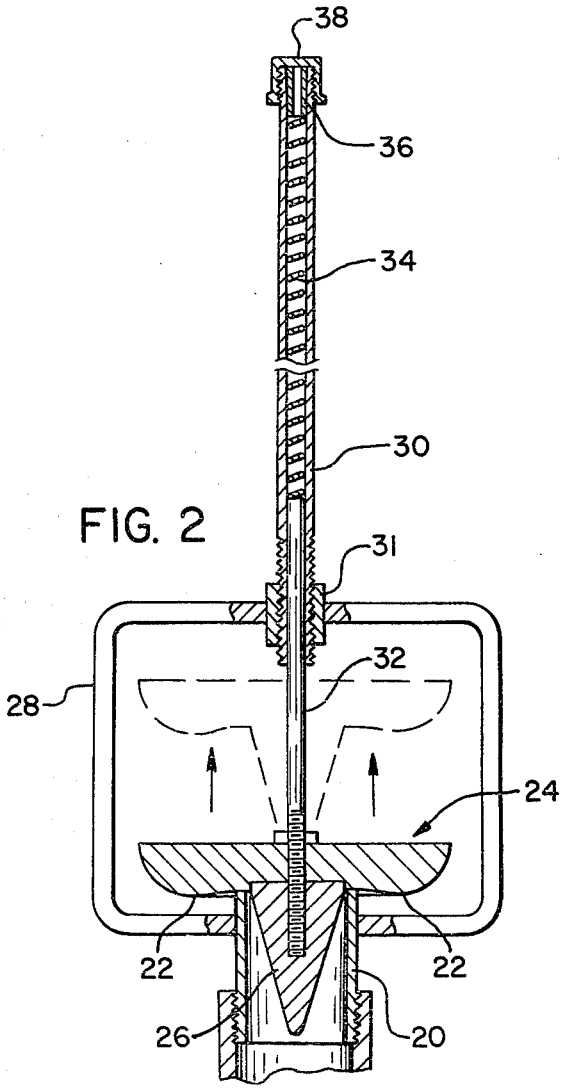
FIG. 2

SPRAY HEAD

BACKGROUND OF THE INVENTION

The present invention relates to spray head devices and more particularly to a spray head device used in association with sewage disposal systems. In the past, floating plate spray heads, such as the spray head illustrated in U.S. Pat. No. 3,198,283 to Moore, have gained acceptance in a number of applications. Such spray heads are advantageous because they are of simple construction; they tend to be self-cleaning, and they include an orifice which expands and contracts in response to changes in pressure within the system. Because the orifice can change size, the flow rate through floating plate spray heads is a linear function of the system pressure whereas in fixed orifice nozzles the flow rate is a function of the square of system pressure. Floating back plate spray heads may thus accommodate increased liquid flow without an exponential increase in system pressure. Also, a floating plate spray head produces a spray pattern annulus which does not vary greatly with changes in liquid flow.

The shape and width of the annulus created by floating plate spray heads have not been highly satisfactory, however, due to the shape of the back plates which have been used in the past. The flow pattern created by a flat back plate such as shown in FIGS. 1 thru 4 of the Moore patent is umbrella shaped with liquid falling in a narrow ring. When tabs are added to the back plate as shown in Moore FIGS. 5 thru 8, the water falls from the nozzle in narrow spider-like streams which are spaced in a circular pattern about the nozzle.

Floating plate spray heads are also inherently disadvantageous because the back plates of such spray heads are biased downwardly by gravitational attraction only, so that downward force on the back plate changes imperceptibly as the back plate rises. When several of such nozzles are connected in parallel to a single source of pressurized liquid, some of the nozzle back plates rise fully while others do not rise at all unless the system is operating at relatively high pressures.

SUMMARY OF THE INVENTION

The spray head of the present invention includes a vertical liquid flow pipe having an upwardly facing open end. A liquid deflecting back plate with an upwardly curving lower surface is positioned over the pipe and is biased downwardly toward the pipe by a spring.

This spray head produces a wider spray pattern than has heretofore been possible with liquid deflecting plates by utilizing the fluid dynamics phenomenon called wall attachment or Coanda effect, named after its discoverer, Henri Coanda. According to the Coanda effect, when a stream of fluid is directed toward an adjacent curved or flat plate which is relatively close to the stream axis, the stream will attach to and flow along the plate. The stream will flow a substantial distance along an upwardly curving plate before it becomes detached.

Liquid which emerges from the vertical pipe of the present invention climbs up the reverse slope of a dish-shaped back plate according to the Coanda effect. At each change in slope of the plate, gravitational forces overcome the momentum of a fraction of the upward moving liquid and that fraction projects off the back plate. The velocity of water striking the back plate is preferably chosen so that in most cases the trajectory of the liquid as it leaves the back plate is at least 45° above horizontal.

Because drops project off the curved Coanda effect back plate in multiple trajectories, the annulus or ring of drops produced by the Coanda effect back plate of the present invention is wider and covers a much greater area than the annuli produced by prior art back plate spray heads. This feature is especially advantageous in installations where multiple spray heads are mounted in array such that overlapping spray pattern annuli cover the entire surface of a prescribed area. Because each Coanda effect spray head produces a substantially uniform, large area spray pattern annulus, liquid can be distributed on the surface by multiple Coanda effect spray heads with greater uniformity than was possible with prior back plate spray heads. Also, spray heads according to the present invention increase system flexibility because they produce spray pattern annuli which do not vary substantially with the flow of liquid. Thus the total spray head coverage area remains substantially constant through a wide range of system pressures and flow rates.

Another advantage of the present invention, especially apparent if the spray head is used for the distribution of liquid sewage, is the absence of a restricted orifice which might clog with sewage. The open ended flow pipe and smooth surfaced back plate have no sites on which strings or other solid materials in the liquid stream could get caught.

Like the prior art floating plate spray heads liquid flow through the spray head according to the present invention is a linear function of the system pressure.

The problem of random back plate rise in a multiple head system is solved in the present invention by the inclusion of a biasing means such as a spring, to exert a light downward pressure, on the top of each back plate. The downward force exerted by each spring increases as the plates rise thereby ensuring that the back plates of all heads move in response to change in system pressure and not in the random fashion of the prior art gravity biased back plate spray heads.

It is an object of the present invention to provide a spray head which projects drops of liquid in multiple trajectories and thereby produces a wide ring-shaped flow pattern anulus.

A further object of the invention is to provide a pattern of large drops a majority of which leave the nozzle at an angle of at least 45° above horizontal.

A further object is to provide a nozzle which can be used in parallel with other similar nozzles in a multiple nozzle system and can be adjusted so that all nozzles in the system rise together and not randomly.

BRIEF DESCRIPTION OF THE DRAWINGS

In the drawings:

FIG. 1 is a diagram illustrating the fluid dynamic phenomenon called the wall attachment or Coanda effect in relation to a back plate of the present invention;

FIG. 2 is a sectional side view of a spray head incorporating a Coanda effect back plate;

FIG. 3 is a sectional side view of another spray head incorporating a Coanda effect back plate; and FIG. 4 is a schematic view of a spraying system incorporating several movable plate nozzles.

DESCRIPTION OF THE PREFERRED EMBODIMENTS

The Coanda effect phenomenon is illustrated in FIG. 1. This diagram shows the attachment of a liquid stream to the surface of a Coanda effect spray head back plate formed in accordance with the invention. Liquid flowing through the upper end of a vertical pipe 10 is divided and deflected in a substantially uniformly thin stream toward the lower convex surface 12 of a dish-shaped back plate 14 by a conical plug 16. Since the axis of the stream is relatively close to the surface 12, the stream attaches to and flows along the surface. The stream undergoes considerable curving during its attachment to the surface 12. Eventually gravitational forces overcome the momentum of the upward moving liquid. At the point where this occurs liquid is projected off the surface.

The amount of water which is projected off from any given point on the surface 12 is a function of the slope of the surface at that point. The steeper the slope of the surface, the less liquid which can be carried by Coanda effect. The surface 12 of the preferred embodiment continuously changes slope from a negative value at points nearest the base of the plug 16 to a slope of infinity at the outermost peripheral edges of the surface 12. Because of this changing slope, liquid projects from the head in mutiple trajectories thereby producing a spray pattern or anulus which is distinctly wider than the annulus produced by prior art spray heads having back plate surfaces with but a single slope, i.e. flat or conical back plates. Liquid leaving the negatively sloped portion of the surface 12 projects downwardly to positions near the pipe 10 to form the inner portion of the annulus. Liquid projecting from the positively sloped portion of the surface 12 leaves that surface in upward trajectories and thus forms the outer portion of the annulus. In order to achieve a maximum annulus width it is desirable to produce a sufficient water velocity along the surface 12 that liquid droplets project from the positively sloped portion of the surface 12 in trajectories of forty-five degrees or more upward from horizontal.

The Coanda effect back plate 14 is especially useful if incorporated in a spray head wherein the back plate is free to move toward or away from the open end of the pipe 10 in response to change in liquid flow rate, because such movable back plates produce a spray pattern annulus which is substantially of a constant diameter. The diameter of the annulus is a function of liquid velocity along surface 12. That velocity in turn is a function of pressure inside the flow pipe.

If the back plate is in a fixed position with respect to the pipe, the diameter of the spray pattern annulus increases greatly with respect to increase in liquid flow because pressure inside the pipe increases as an exponential function of flow. If the back plate is free to move, however, the annulus diameter does not vary substantially with changes in liquid flow because pressure inside the pipe is a lineal function of flow. Thus, by selecting a back plate of the appropriate shape and weight and mounting it so that it can move in response to changes in liquid flow rate, the optimum velocity of liquid moving along the surface 12 and therefore the optimum anulus width may be maintained substantially throughout a range of liquid flow rate.

Referring now to FIG. 2, a spray head constructed in accordance with the invention includes a vertical liquid flow pipe 20 and a movable Coanda effect back plate 24 having an upwardly curving generally convex lower surface 22. A conical plug 26 is attached to the surface 22 and extends into the open end of the liquid flow pipe 20 so that liquid emerging from the flow pipe will be divided substantially uniformly and will flow along the surface 22 and so that the back plate 24 will rise gradually with flow instead of abruptly. In this embodiment the back plate 24 is adapted for motion between a closed position as illustrated in solid lines and various open positions one of which is shown in broken lines. In the closed position the lower surface 22 is flush with the open end of the liquid flow pipe 20 and the conical plug 26 extends into the pipe.

Means are provided for supporting the back plate for movement toward and away from the open end of the flow pipe 20. In the embodiment of FIG. 2 the support means includes a lateral support member 28. Attached to the support member 28 is a retaining means consisting of a vertically extending cylindrical tube 30, which is fixed to the support member 28. One end of a cylindrical rod 32 is connected to the back plate 24 and the other end is slidably retained inside the tube 30 so that the rod 32 serves as a guide member. In this embodiment the tube 30 and rod 32 are in axial alignment with the pipe 20 to maintain the back plate in a centered position over the pipe 20. A variety of other alignments would be equally suitable.

Located within the tube 30 above the rod 32, is a compression spring 34 which serves as a biasing means to urge the rod 32 and the back plate 24 downwardly. The spring is retained inside the tube by a plug 36 and a spring retention cap 38 threaded onto the top of the tube 30. Adjustment means are provided for varying the force exerted by the biasing means. In the embodiment of FIG. 2 several different members can serve as the adjustment means. Adjustment is accomplished by rotating the tube 30 to change the vertical position of the tube 30 in relation to the bushing 31, by rotating the spring retention cap 38 to raise or lower the plug 36, or by replacing the plug 36 with another plug of a different length.

FIG. 3 shows another embodiment of a Coanda effect spray head having many of the same features as the spray head shown in FIG. 2, including a liquid flow pipe 40, a movable Coanda effect back plate 44 with a convex lower surface 42, a conical plug 46, and a cylindrical rod 52 mounted on the top of the back plate 42. In this spray head, however, the lateral support member comprises a hollow beam 48 suitably supported at its ends and extending over the pipe 40. Extending through threaded bushings 47, 49 fixed in the upper and lower flanges of the beam 48 is an externally threaded tube 50. Threaded onto the lower portion of the tube 50 is a preload adjusting plate 53. Retained between the lower surface of the preloaded adjusting plate 53 and the upper surface of the Coanda effect back plate 44 is a compression spring 54 which biases the back plate 44 downwardly. The preloaded adjustment of this spring is accomplished by rotating the preload adjusting plate 53 and thereby either compressing or decompressing the spring.

OPERATION

The spray heads of FIGS. 2 and 3 operate in similar fashion. Liquid under pressure in the pipe exerts an upward force on the Coanda effect back plate. When this force is sufficient to overcome the downward force exerted by gravity and the spring, the back plate rises and liquid flows up through the pipe and along the lower convex surface of the back plate according to the previously described Coanda effect. Because the size of the spray head orifice varies as a function of liquid flow, the velocity of liquid contacting the back plate changes very little throughout a wide range of liquid flow rates. The spray pattern anulus is therefore of substantially a constant size over the same range of flow rates.

FIG. 4 is a schematic diagram of the spraying system in which several movable plate spray heads 60 of the present invention are used in parallel. In this illustration the spray heads 60 are each mounted on a lateral distribution pipe 62 which supplies liquid to each of the spray heads at about the same pressure.

When multiple spray heads are used in parallel, the height to which each spring biased back plate rides is a direct function of system pressure because the downward force exerted by the spring increases as the back plate rises. Spring biased back plates rise simultaneously because liquid flows along the path of least resistance to the back plates against which the least downward force is exerted so that the downward force exerted against all the back plates tends to be equal. In other words if one spring biased back plate rises even slightly in response to an increase in system pressure, the downward force of the spring against that back plate is increased. That back plate will rise no further until all other back plates have risen to the point where the downward force exerted against each of the back plates is equal to the downward force on the one back plate. The downward forces exerted by the spring need not be large to have the desired effect. To prevent a build up of extra pressure in the system it is desirable to choose a spring which produces the minimum acceptable downward force.

The simultaneous rising in response to pressure change distinguishes spring biased back plates from gravity biased back plates. When multiple gravity biased back plate spray heads are used in parallel, one back plate may rise to its maximum height before a second back plate even starts to rise because the downward force exerted by gravity on each back plate is substantially the same, regardless of the plate's height, until it reaches its maximum height.

By adjusting the spring preload of each spray head it is possible to choose the order in which spring biased back plates will begin to rise as pressure in the pipe 62 increases. If it is desired that the back plates of all spray heads begin to rise simultaneously, the preload of each spring is adjusted to be equal. If it is desired that the back plates of certain spray heads are to rise first, the preload compression of the spring is lowered for those nozzles and/or raised for the remaining nozzles.

Because the size of the nozzle orifice is free to vary with change in the system pressure, the rate at which liquid flows through each spray head is approximately a linear function of the pressure in the pipe. If it is desirable that the flow rates through each spray head increase equally as a function of pressure, springs having a uniform spring content should be used in each of the spray heads. If, however, it is desired that the flow rates through various spray heads increase as different functions of the pressure in the system, springs with differing spring constants may be used in the various spray heads.

Multiple spray heads according to the present invention may be used to spray liquid over the entire surface of a given area by mounting the heads in a fixed array in which the annuli of adjacent spray heads overlap. Preferably the heads should be arranged so that each spray head is located just inside the spray pattern annuli of all immediately adjacent heads. A hexagonal array is conveniently used such that any designated spray head, except for those heads near an edge of the array, has six adjacent heads within its spray pattern annulus, the designated head and six adjacent heads being spaced equidistant from each other. Because the annuli of spray heads according to the present invention are wide, cover a large area and do not vary substantially with changes in liquid flow, such heads may be spaced farther apart and yet produce a more uniform overall distribution pattern than is customary for such arrays.

While we have shown and described preferred embodiments of our invention, it will be apparent to those skilled in the art that other changes and modifications may be made without departing from our invention in its broader aspects.

We claim:

1. A spray head apparatus utilizing the Coanda effect comprising:

a substantially vertical liquid flow pipe having an upwardly facing outlet end; and a liquid deflecting backplate positioned over said pipe having an upwardly curving, generally convex lower surface facing said outlet end, said lower surface being of sufficient size relative to said outlet end and continuously changing in slope from a negative value near the center of said surface to a slope of infinity at its outermost peripheral edge so that a flow of liquid emerging with predetermined minimum velocity from said outlet end will attach to said lower surface due to the Coanda effect and project off of said lower surface in multiple trajectories to produce a wide and substantially uniform spray pattern annulus.

2. Apparatus of claim 1 further comprising:

support means supporting said back plate for movement vertically toward and away from said flow pipe outlet end.

3. Apparatus as defined in claim 2 wherein said lower surface is formed to fit in a closed position against said pipe outlet end.

4. Apparatus of claim 2 wherein said support means comprises:

a guide member attached at one end to the upper surface of said back plate;

a lateral support member mounted in a fixed position relative to said pipe; and retaining means secured to said support member slidably retaining said guide member so that said back plate is axially movable toward and away from said outlet end.

5. Apparatus of claim 4 wherein said guide member is axially aligned with said pipe.

6. Apparatus of claim 2 further comprising:

biasing means for urging said back plate toward said closed position.

7. Apparatus of claim 6 wherein said biasing means includes adjustment means for varying the force exerted by said biasing means.

8. A spray head apparatus utilizing the Coanda effect comprising:

a substantially vertical liquid flow pipe having an upwardly facing outlet end;

a liquid deflecting backplate positioned over said pipe having an upwardly curving, generally convex lower surface facing said outlet end, said lower surface being of sufficient size relative to said outlet end and having a sufficient curvature, that a flow of liquid emerging with predetermined minimum velocity from said outlet end will attach to said lower surface due to the Coanda effect and project off of said lower surface in multiple trajectories to produce a wide spray pattern annulus which does not vary substantially in diameter with changes in liquid pressure inside said pipe;

a substantially conical plug secured on said lower surface with its point directed toward said pipe, said plug being axially aligned with said pipe and having a base which is substantially smaller than said lower surface and smaller than the inner diameter of said flow pipe so that an annular orifice is formed between said pipe and said plug at said outlet end and said flow of liquid emerging from said outlet end is diverged into a substantially conical sheet before striking said lower surface to enhance the extent of said flow's Coanda effect attachment; and support means supporting said backplate for movement vertically toward and away from said flow pipe outlet end so that:

a. when there is no pressure in said flow pipe, said lower surface rests against said pipe outlet end and substantially the entire volume of said plug extends into said flow pipe, and b. as pressure inside said pipe increases, said backplate rises, said plug is lifted out of said flow pipe and, due to the conical shape of said plug, said orifice increases in size to maintain the velocity of said flow of liquid substantially constant regardless of changes in flow volume whereby the diameter of said spray pattern annulus is maintained substantially constant.

9. Apparatus of claim 8 further comprising:

guide means attached to said backplate for maintaining said plug in axial alignment with said pipe;

biasing means, including a compression spring, for urging said backplate downwardly; and adjustment means mounted on said guide means to regulate the force exerted by said biasing means.

10. A spray head apparatus utilizing the Coanda effect comprising:

a substantially vertical liquid flow pipe having an upwardly facing open end;

a liquid deflecting back plate positioned over said pipe having an upper surface and an upwardly curving, generally convex lower surface facing said open end so that liquid emerging from said open end flows along said lower surface and projects off of said lower surface in multiple trajectories, said lower surface being movable toward and away from said open end in a direction parallel to the axis of said pipe;

a cylindrical rod axially aligned with said pipe and attached at one end to said upper surface;

a lateral support member mounted on and extending over said pipe;

a threaded bushing secured on said support member;

an externally threaded tube extending through said bushing slidably retaining said rod;

a compression spring positioned inside said tube above said rod to urge said rod downwardly;

a plug positioned inside said tube above said spring for retaining said spring inside said tube;

a cap secured to the upper end of said tube for retaining said plug inside said tube; and a substantially conical plug secured on said lower surface and axially aligned with said pipe.

11. A spray head apparatus utilizing the Coanda effect comprising:

a substantially vertical liquid flow pipe having an upwardly facing open end;

a liquid deflecting back plate positioned over said pipe having an upper surface and an upwardly curving, generally convex lower surface facing said open end so that liquid emerging from said open end flows along said lower surface and projects off of said lower surface in multiple trajectories, said lower surface being movable toward and away from said open end in a direction parallel to the axis of said pipe;

a cylindrical rod axially aligned with said pipe and attached at one end to said upper surface;

a beam fixedly supported at its ends and extending over said pipe;

a threaded bushing fixed on said beam;

an externally threaded tube extending through said bushing slidably retaining said rod;

a preload adjusting plate threaded onto a portion of said tube which portion extends below said beam;

a compression spring retained between said adjusting plate and said back plate for urging said back plate downwardly, the preload compression of which spring is adjusted by rotating said adjusting plate about said tube to alter the vertical displacement of said adjusting plate; and a substantially conical plug secured on said lower surface and axially aligned with said pipe.

12. A spray head apparatus utilizing the Coanda effect comprising:

a substantially vertical liquid flow pipe having an upwardly facing open end;

a liquid deflecting backplate positioned over said pipe having an upwardly curving, generally convex lower surface facing said open end so that liquid emerging from said open end flows along said lower surface and projects off of said lower surface in multiple trajectories;

a cylindrical rod attached at one end to the upper surface of said backplate;

a lateral support member mounted in a fixed position relative to said pipe;

a cylindrical tube secured to said support member to slidably retain said rod so that said backplate is axially movable toward and away from said open end; and biasing means operatively connected to said rod for urging said rod downwardly.

13. Apparatus of claim 1 wherein said lower surface is shaped such that said flow can upwardly project off said lower surface in trajectories at least 45° above horizontal.

* * * * *